US006892824B2

(12) United States Patent
Torrey

(10) Patent No.: US 6,892,824 B2
(45) Date of Patent: May 17, 2005

(54) METHOD AND APPARATUS FOR PICKING UP SEAWEED AND OTHER LITTER

(76) Inventor: John E. Torrey, 7253 Yaupon, Corpus Christi, TX (US) 78414

( * ) Notice: Subject to any disclaimer, the term of this patent is extended or adjusted under 35 U.S.C. 154(b) by 0 days.

(21) Appl. No.: 10/196,519

(22) Filed: Jul. 15, 2002

(65) Prior Publication Data

US 2004/0007367 A1 Jan. 15, 2004

(51) Int. Cl.[7] ..... E02F 3/80

(52) U.S. Cl. ..... 172/701.3; 172/766; 37/454; 171/111

(58) Field of Search ..... 172/749, 766, 172/772, 772.5, 811, 701.1, 701.3, 651, 701.2, 713, 753; 37/446, 452, 454, 455; 171/45, 46, 111, 112, 124, 125, 144, 140, 143

(56) References Cited

U.S. PATENT DOCUMENTS

| | | | | | |
|---|---|---|---|---|---|
| 349,685 | A | | 9/1886 | Botsford | |
| 891,709 | A | | 6/1908 | Lamme | |
| 1,340,385 | A | * | 5/1920 | Edmondson | 37/455 |
| 1,424,750 | A | * | 8/1922 | Anglemeyer et al. | 37/455 |
| 1,544,222 | A | * | 6/1925 | Crosby | 37/455 |
| 2,227,670 | A | * | 1/1941 | Peterson | 172/699 |
| 2,627,712 | A | | 2/1953 | Chatten | |
| 3,059,357 | A | * | 10/1962 | Irish | 37/449 |
| 3,163,945 | A | * | 1/1965 | Dooley | 37/405 |
| 3,349,933 | A | * | 10/1967 | Simpson et al. | 414/724 |
| 3,653,133 | A | * | 4/1972 | Black et al. | 37/450 |
| 3,762,577 | A | | 10/1973 | Olmo | |
| 3,834,567 | A | * | 9/1974 | Miller | 414/724 |
| 3,975,844 | A | * | 8/1976 | Olson | 37/405 |
| 4,007,550 | A | * | 2/1977 | Stepe | 37/448 |
| 4,015,348 | A | * | 4/1977 | Gee et al. | 37/407 |
| 4,050,518 | A | | 9/1977 | Gilmour | |
| 4,120,105 | A | * | 10/1978 | Stepe | 37/455 |
| 4,671,000 | A | * | 6/1987 | Kim | 37/451 |
| 4,753,299 | A | * | 6/1988 | Meyers | 172/777 |
| 4,768,331 | A | | 9/1988 | Jones | |
| 5,906,243 | A | * | 5/1999 | Clausen | 172/33 |
| 6,457,268 | B1 | * | 10/2002 | Perry et al. | 37/403 |
| 6,718,662 | B1 | * | 4/2004 | Schaff | 37/405 |

OTHER PUBLICATIONS

Rockland Manufacturing Co.—Catalog p. 16 Bedford, Pennsylvaniia.

* cited by examiner

*Primary Examiner*—Robert E. Pezzuto
*Assistant Examiner*—Nathan S Mammen
(74) *Attorney, Agent, or Firm*—G. Turner Moller

(57) ABSTRACT

Seaweed is picked up from the surface of a beach with general purpose earth moving machinery by installing a series of fingers extending forwardly and downwardly from the blade or bucket of the machine. By driving the machine forwardly along the beach, the fingers pass through the sand and seaweed on the beach travels up the incline of the fingers. The fingers accordingly act as a separator to separate most of the seaweed from most of the sand. Several embodiments of each moving machines are adapted for seaweed handling or removal.

13 Claims, 5 Drawing Sheets

METHOD AND APPARATUS FOR PICKING UP SEAWEED AND OTHER LITTER

This invention relates to a method and apparatus for picking up seaweed and other litter off a beach.

BACKGROUND OF THE INVENTION

Wind, waves and tides deposit a wide variety of seaweed, debris and the like on beaches. In tourist areas, considerable effort is spent in cleaning beaches to make them tidy, attractive and pleasant. Because these cleaning efforts can be labor intensive and thereby costly, special purpose machines have been proposed to dig up part of the sand on the surface and pass it through a screening device to remove debris, as shown in U.S. Pat Nos. 2,627,712 and 4,050,518.

Efficiently picking up and disposing of seaweed is an altogether different proposition than screening sand to remove debris. The quantity of seaweed deposited on a beach is a function of how much seaweed is in the water and how fast the seaweed is being driven toward the beach. Fortunately, seaweed is deposited on beaches periodically, often in a seasonal pattern. The distribution of seaweed on the beach is more a function of the tides because any seaweed deposited will be between the high and low tide. In an area where tides are not large, as in the western Gulf of Mexico, seaweed will be deposited in a relatively narrow band. Similarly, in areas where tidal movements are larger but the slope of the beach is relatively steep, seaweed will be deposited in a narrow band. In locations where tidal movement is large, seaweed will be deposited in a wider band, the upper end of which is the high tide and the lower end of which is water level.

To date, the known technique for removing seaweed is to use a front end loader, scrape the seaweed and a few inches of sand off the surface, put the material in a dump truck and haul it to a convenient site, usually near the dune line. This type operation is relatively slow and thus relatively expensive. A typical operation comprises one front end loader, two or three dump trucks and the necessary operators and supervisors. Depending on the amount of seaweed involved, experienced crews of this size can typically clean two-tenths of a mile of beach per eight hour day. An inspection of the sand-seaweed piles shows that the major proportion of the hauled material is sand.

The fingers of this invention appear superficially similar to root rakes which are attached to bull dozer blades for the purpose of uprooting brush and small trees. These root rakes are typically attached to pivot connections at the top of the bull dozer blade and extend in front of the blade.

Other disclosures relevant to this invention are found in U.S. Pat. Nos. 349,685; 891,709; 3,762,577 and 4,768,331.

SUMMARY OF THE INVENTION

In this invention, general purpose motorized earth moving machinery is equipped with an attachment on the earth working blade that provides a series of long, tine like downwardly inclined fingers. The vehicle is driven along the beach with the earth working blade lowered so the fingers extend into the sand by at least an inch or so. If seaweed is the only litter to be picked up, the fingers may be fairly widely spaced apart, e.g. one foot. If other litter is intended to be picked up, the fingers will be spaced closer, e.g. every three inches on centers. The seaweed or other litter is pushed up the incline of the fingers by the forward movement of the vehicle, leaving the sand behind thereby separating most of the seaweed or litter from most of the sand.

In one embodiment of this invention, the earth moving vehicle is a scraper, preferably of the type incorporating an elevating paddle assembly. The fingers attach to the scraper blade and inclined downwardly away from the bowl. By driving the scraper along the beach with the scraper blade above the sand surface and the fingers in the sand, seaweed or other litter is separated from the bulk of the sand at the fingers and the seaweed or litter moves upwardly into the scraper bowl. The elevating paddle assembly pushes the seaweed or litter rearwardly into the bowl. When the bowl is more-or-less full, the scraper drives to a disposal area and the seaweed or litter is dumped, using the mechanism of the scraper to do so.

In another embodiment of this invention, the earth moving vehicle is a motor grader or maintainer. The fingers attach to the blade in a similar manner and incline downwardly from the blade. By driving a motor grader equipped with this invention along the beach with the blade at an angle, the seaweed or other litter accumulates in windrows parallel to the direction of movement of the motor grader and may be picked up in a conventional manner or the motor grader can traverse the beach again, moving the windrow landward. Because the blade is at an angle, the fingers are inclined at an acute angle to the blade so the fingers are parallel to the direction of movement of the motor grader.

In another embodiment of this invention, the earth moving vehicle is a front end loader. The fingers attach to the bucket in a desirable fashion, such as being received in the teeth sockets. Rather than scoop up large quantities of sand, the fingers separate most of the seaweed or other litter from most of the sand before the seaweed or litter enters the bucket.

A trial of this invention using a conventional elevating scraper equipped with fingers designed to pick up seaweed showed that the proportion of sand in the pile is very low, i.e. there is little or no loose sand and the only sand found in a sand-seaweed pile are sand grains sticking to the seaweed.

The method of this invention is inserting a series of inclined fingers carried by a motorized vehicle into the sand of a sandy beach, driving along the beach and separating seaweed or other litter from the sand on the fingers while transporting the seaweed or litter upwardly along the fingers.

It is an object of this invention to provide an improved method and apparatus for removing seaweed or other litter from a beach.

Another object of this invention is to provide a machine for removing seaweed or other litter from a beach.

A further object of this invention is to provide an attachment for a general purpose earth moving machine to convert it for removing seaweed or litter from a beach.

These and other objects and advantages of this invention will become more apparent as this description proceeds, reference being made to the accompanying drawings and appended claims.

DETAILED DESCRIPTION

Figure 1:
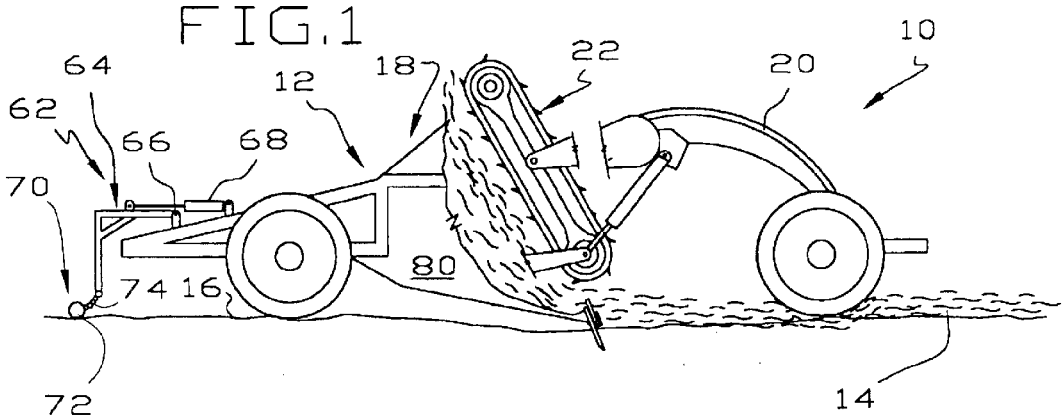
FIG. 1 is a side elevational view of a scraper equipped with a seaweed removing attachment of this invention, certain parts being broken away for clarity of illustration.

Referring to FIGS. 1–7, there is illustrated a seaweed removing device 10 of this invention which uses a general purpose earth working device known as a scraper 12 which has been converted to efficiently remove seaweed 14 from a sandy beach 16 bordering a body of water which periodically deposits litter on the beach. The scraper 12 may be any suitable type and is illustrated as comprising a bowl 18 mounted on a wheeled frame 20 pulled by a tractor (not shown). Conventional scrapers comprise either an apron or an elevating paddle assembly 22 on the front of the bowl 18. The paddle assembly 22 conveniently piles seaweed up in the bowl 18 as will be more fully apparent hereinafter. Conventional scrapers include means for emptying the bowl 18, either in the form of a pusher which is normally hydraulically driven forwardly in the bowl or by providing a retractable bowl bottom wall or floor 24.

Many types and sizes of conventionally available scrapers are usable in this invention, such as are made by Caterpillar Inc. of Peoria, Ill., Clarendon Manufacturing and Distribution Co. of Clarendon, Tex. and Deere & Co., Inc. of Moline, Ill. More complete descriptions of conventional scrapers are found in publications of the manufacturers. A particularly desirable scraper is a Clarendon Model 24 because it is a 4 cubic yard scraper that can be towed behind a modest farm tractor.

Conventional scrapers 12 include an earth working blade 26 removably attached to the forward end of the bowl 18 for cutting a few inches of material from the surface of the earth. In this invention, a plurality of tines or fingers 28 are attached to the blade support 30, either with the blade 26 on or off. It is preferred to leave the blade 26 on because any wear that occurs is on the blade 26 rather than on the support 30. It will be apparent to those skilled in the art that different manufacturers may have different blade support designs but all blade supports have the ability to remove and therefore replace the blade 26. All blades 26 include openings 32 receiving threaded fasteners such as bolts or machine screws 34 captivating the blades 26 to the blade support 30. An important feature of this invention is to use the openings 32 to attach the tines 28 of this invention.

Figure 3:
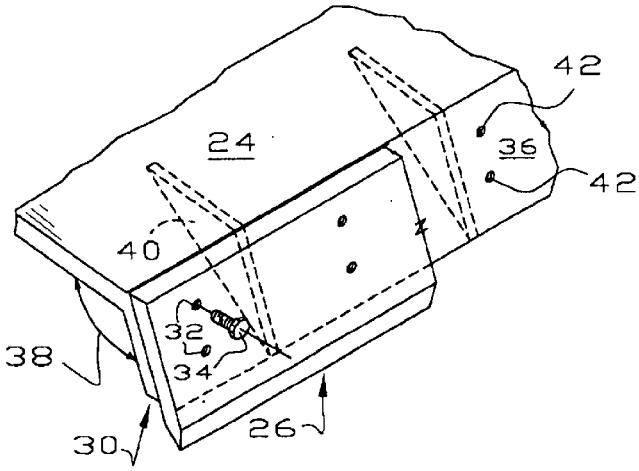
FIG.3 (PRIOR ART)
FIG. 3 is an isometric view of one end of the earth working blade of the scraper of FIGS. 1 and 2, showing the attachment of the blade to the scraper bowl.
Figure 4:
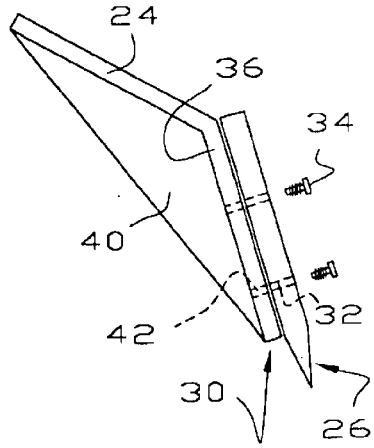
FIG.4 (PRIOR ART)
FIG. 4 is a side view of FIG. 3, showing the attachment of the blade to the scraper bowl.
Figure 5:
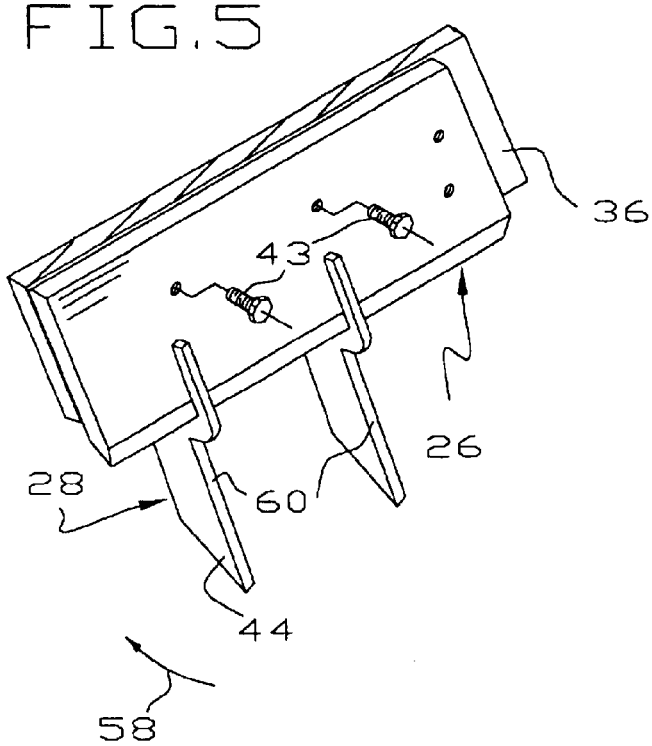
FIG. 5 is an isometric view similar to FIG. 3 showing a seaweed removing tine of this invention secured to the blade of the scraper.

As shown in FIGS. 3–4, a typical blade support 30 includes a backing member or plate 36 affixed at an obtuse angle 38 to the bottom 24 of the scraper 12. A series of gussets 40 are welded to the underside of the bottom 24 and to the plate 36 along the open end of the scraper bowl 18 thereby stiffening the plate 36 and the bowl bottom 24 adjacent the plate 36. Between the gussets 40 are pairs of openings 42 which align with the openings 32 to receive the bolts 43 and thereby clamp the blade 26 to the plate 36. It will be seen that the bolts 43 have to be longer than the bolts 34 to accommodate the additional thickness of the plate 50.

In this invention, the tines 28 are attached to the blade 26 and/or the blade support 30 by removing the bolts 34, placing the tines 28 on the blade 26 or the blade support 30 and installing the new bolts 43. It will be apparent that the blade 26 may be removed if desired. To this end, the tines 28 comprise a ground engaging or earth working end 44, a support end 46 receiving the bolts 43 and a hook or slot forming member 48 for receiving the blade 26 and/or the plate 36. The tine 28 is typically made of metal to provide a strong, durable implement. Looked at in another way, the finger comprises an earth working tip, a support end, a main body section extending from the tip to the support end and a slot forming member 48. The support end 46 includes a flat plate 50 having openings 52 sized and spaced to align with the openings 32, 42 and receive the bolts 43. One or more gussets or braces 54 strengthen the plate 50 and allow the bolts 43 to extend through the tines 28 and receive nuts (not shown). The hook or slot forming member 48 is spaced from an edge 56 an appropriate distance to receive the blade 26 and/or plate 36 and thereby brace the tine 28 against forces tending to rotate the tine 28 in the direction shown by the arrow 58 in FIG. 5. It will be evident that the design of the blade supports 30 and the size and spacing of the fasteners 34 of different manufacturers may differ substantially. Thus, it may be necessary to provide different designs of the support end 46 of the fingers 28 to accommodate the different designs of different manufacturers.

Figure 6:
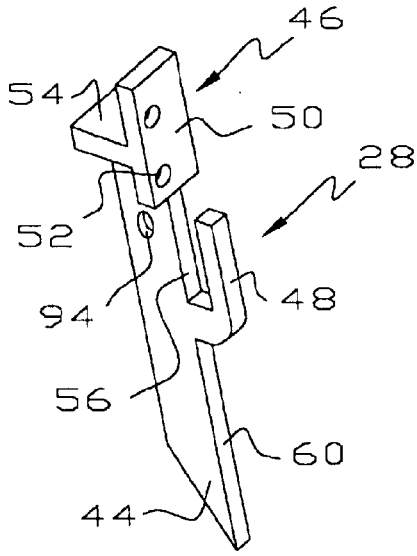
FIG. 6 is an isometric view of the seaweed removing tine shown in FIG. 4.

As illustrated in FIG. 6, the plate 50 is above the plane of the bottom of the slot provided by the slot forming member 48. This means, as illustrated, the slot is large enough to receive the blade 26 and the support plate 36. To make the finger 28 fit more snugly on the blade 26 and support plate 36, the slot may be made narrower with the plate 50 being recessed so it is more-or-less flush with the bottom of the slot.

Seaweed is obviously plant material and tends to be long and slender. Thus, the fingers 28 may be relatively widely spaced and still pick up most of the seaweed. The blade supports 30 of conventional scrapers typically space the openings 32 in the range of 6"–18" apart laterally along the width of the bowl 18. Fortuitously, this spacing works well for picking up seaweed with the fingers 28.

With the tines 28 attached to the forward end of the bowl 18, the seaweed removing device 10 is driven along a sand beach 16 littered with seaweed. The scraper bowl 18 is lowered by manipulation of hydraulic cylinders on the scraper 12 in a conventional manner to lower the tines 28 so they pass a few inches into the sand. Seaweed 14 on the beach 16 rides up the incline of the edges 60 provided by the ground engaging ends 44 of the fingers 28 thereby leaving most of the sand behind on the beach 16. Thus, the tines 28 have a separating function to remove most of the seaweed 14 and leave behind most of the sand. The paddle assembly 22 is actuated at an appropriate time to push seaweed upwardly over the pile of seaweed in the bowl 18 so the bowl 18 fills in much the same manner that the bowl would be filled with earth material in a conventional operation. When the bowl 18 is full, the operator raises the bowl 18 so the fingers 28 come upwardly out of the sand. The operator then drives to a convenient dump location and discharges the seaweed from the bowl 18 as shown in FIG. 2. In the conventional paddle assembly scraper 12 shown in FIGS. 1 and 2, this is accomplished by retracting the bottom wall or floor 24 and driving through the dump area, typically operating the paddle assembly 22 in reverse to facilitate forward movement of the seaweed.

A trial of this invention has been conducted as described. A 4000' long and 8' wide swath of beach was cleaned in 70 minutes. The scraper bowl had a capacity of 13 cubic yards and was filled a number of times. The loads of seaweed were simply driven to the dune line and dumped in a long path. An inspection of the seaweed piles showed very little free sand was discharged at the dump locations. There was some sand sticking to the seaweed but the proportion of transported sand to seaweed was a small fraction of prior art cleaning techniques. It is apparent that the length of time necessary to clear a beach of seaweed depends, in part, on the volume of seaweed per unit area because the device 10 has to drive to the dump location and discharge the load before starting again on the beach. This same factor obviously affects conventional cleaning techniques. People experienced in cleaning seaweed from beaches using conventional techniques estimate that a 13 cubic yard capacity bowl 18 equipped with the seaweed removing fingers 28 of this invention is capable of cleaning many miles of beach per day compared to two tenths of a mile per day with conventional techniques.

Figure 2:
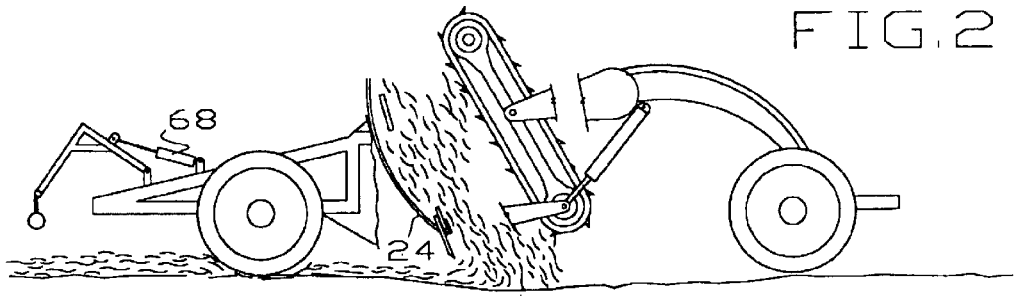
FIG. 2 is a view similar to FIG. 1 illustrating the scraper dumping seaweed collected in the bowl.
Figure 7:
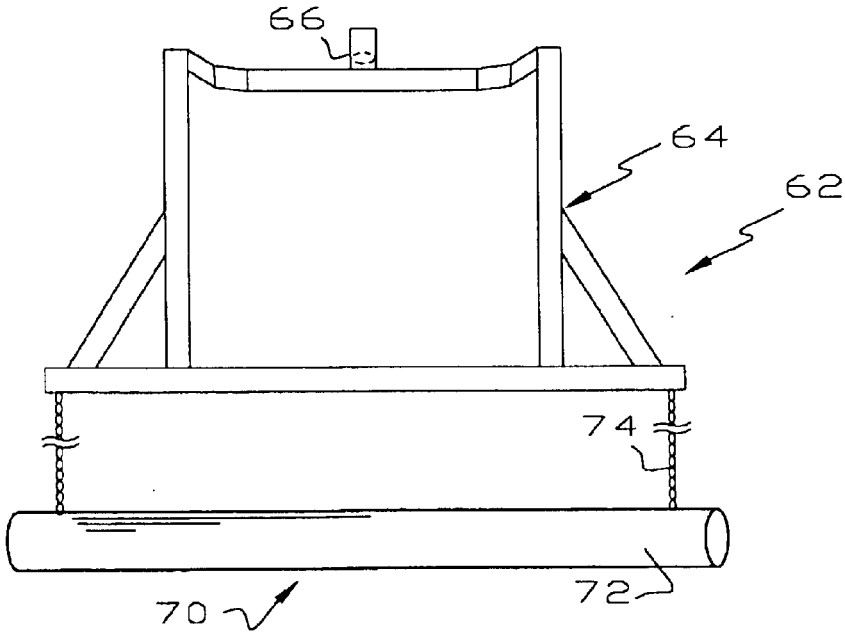
FIG. 7 is a top view of a drag bar used to smooth the furrows created by the seaweed removing attachment of this invention.

Referring to FIGS. 1, 2 and 7, a drag bar assembly 62 is provided on the end of the device 10 to smooth the furrows dug in the sand beach 16 by the fingers 28. The drag bar assembly 62 comprises a frame 64 pivoted onto the rear of the device 10 by a pivot connection 66. A pneumatic or hydraulic cylinder 68, under the control of the operator, is used to raise and lower the frame 64 and thereby position a drag element 70 on the surface of the sand beach. The drag element 70 may comprise a rigid pipe 72 connected to the frame 64 by chains 74 or may simply comprise a chain.

Figure 8:
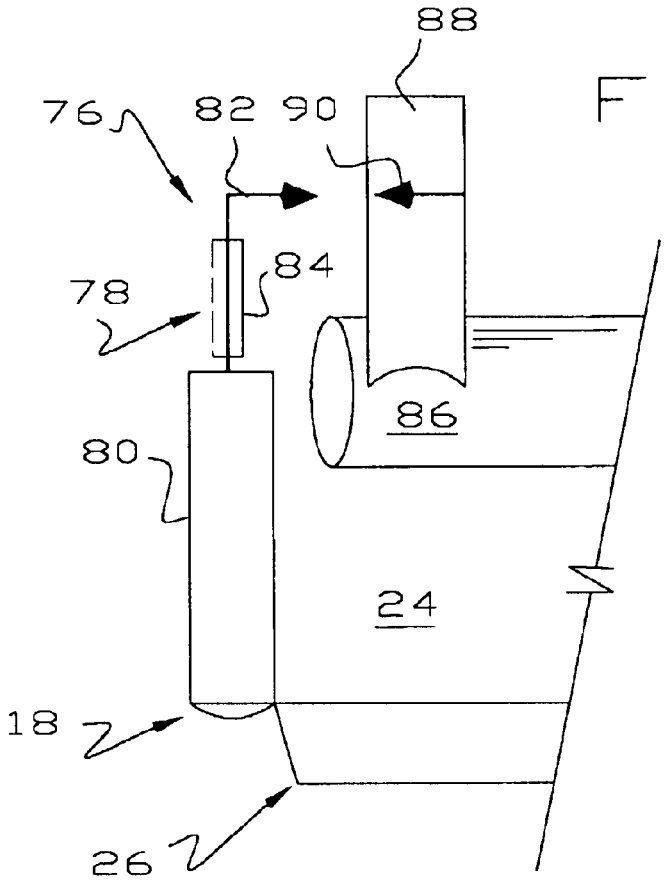
FIG. 8 is a view of an indicator, looking rearward from an operator's station, showing the depth of seaweed removing fingers in the sand beach.

Referring to FIG. 8, another feature of this invention is illustrated. Experienced scraper operators typically adjust the position of the earth working blade 26 and the speed of the scraper 12 in response to a judgment of the load on the scraper motor. For example, if the scraper motor is struggling, it means that too deep a cut is being made so the bowl 18 is raised or it means the scraper is going too fast so the scraper is slowed. Similarly, if the scraper motor is coasting, it means that too shallow a cut is being made so the bowl 18 is lowered or it means the scraper is going too slow and the scraper speed is increased. This time honored technique doesn't work well when removing seaweed because the load on the scraper motor is never very much.

As shown in FIG. 8, an indicator 76 is provided having a mast or brace 78 fixed to the bowl 18 so it is rigid with the blade support 30. The brace 78 may be fixed to the bottom wall 24 or to some component that is fixed to the blade support 36 or may be fixed to a side wall 80 of the bowl 18 so that when the bottom wall 24 is lowered to an earth engaging position, the distance between the blade support 36 and a pointer 82 is known. The indicator 76 preferably includes an adjustable joint 84 for purposes more fully apparent hereinafter.

Mounted on a main arm 86 or other fixed point on the frame 20 is a member 88 having a second pointer or mark 90 cooperating with the pointer 82. It will be apparent that the relationship between the pointers 82, 90 is an indication of the depth of the fingers 28. The indicator 76 may be calibrated simply by plunging the fingers 28 into the sand to what is a desired depth and adjusting the joint 84 so the pointers 82, 90 align.

Figure 9:
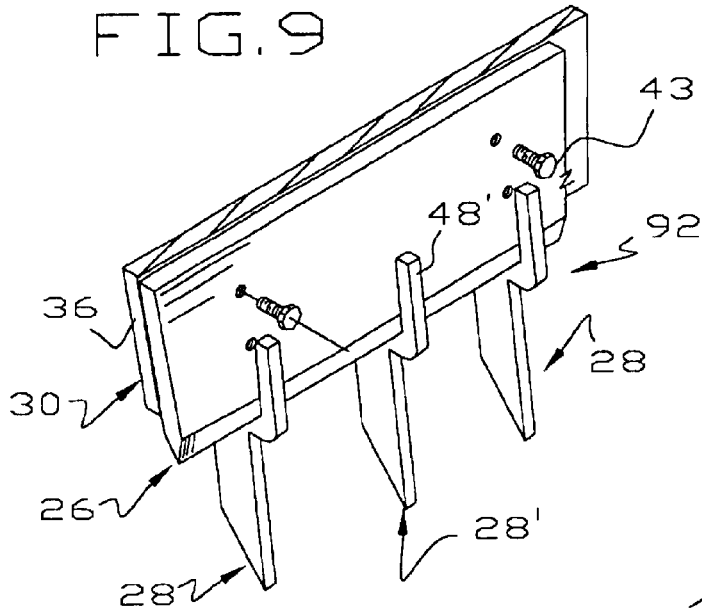
FIG. 9 is an isometric view of a modified finger arrangement that places the fingers close together to pick up other litter from a beach.
Figure 10:
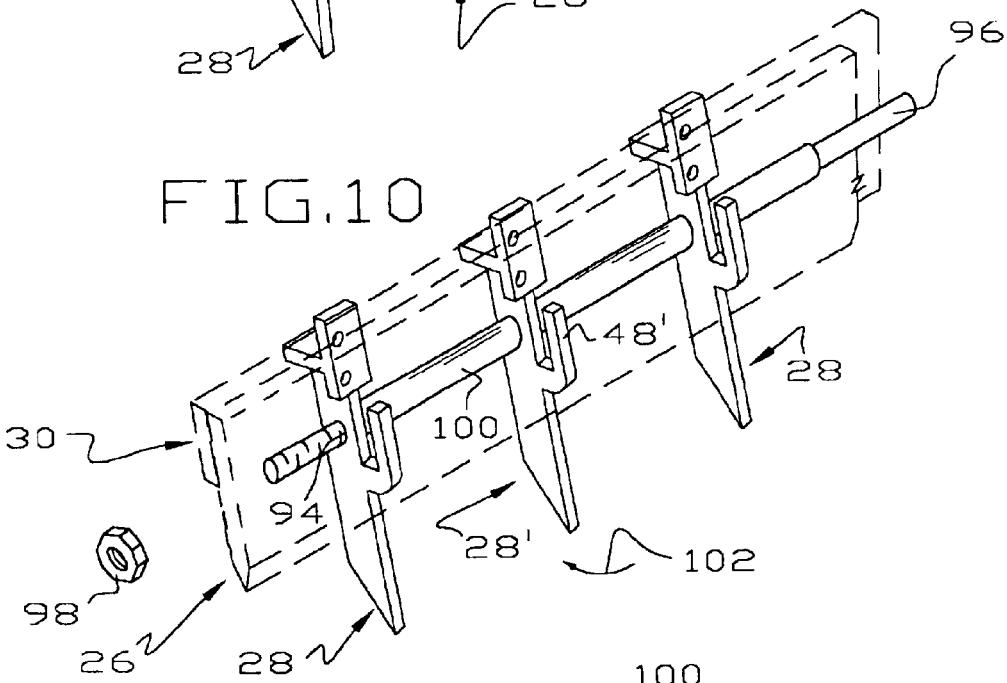
FIG. 10 is an isometric view similar to FIG. 9 except that the blade and blade support are shown in phantom lines for purposes of illustration.

Referring to FIGS. 9–10, there is illustrated a modification of the seaweed removing device 10 so it is also capable of picking up litter off the beach 16. The problem with using the device 10 of FIGS. 1–7 to pick up litter is that the fingers 28 are so far apart that most of the litter passes between the fingers 28 along with the sand and is not moved up the incline of the edges 60 into the bowl 18.

To overcome this defect and provide more closely spaced fingers 28 that are connected to the blade support 30, an assembly 92 is provided as shown in FIGS. 9 and 10. FIG. 9 will be seen to be similar to FIG. 5 except that at least one additional finger 28' is provided between the fingers 28, the finger 28' not being secured by fasteners 43 to the blade 26 and blade support 30.

The fingers 28, 28' may be identical if that is convenient or the finger 28' may be made with the support end 46 missing. Making the fingers 28, 28' identical has an advantage because the plate 50 will abut the back of the support plate 36 thereby assisting to prevent rotation of the finger 28' even though it is not bolted up. The fingers 28, 28' include a passage 94 receiving a rod 96 extending along the width of the blade 26 sufficient to pass through all of the fingers 28, 28'. The ends of the rod 96 are stabilized in any convenient manner, as by the provision of nuts or keepers 98 on the ends. Thus, the rods 96 support the intermediate fingers 28' from moving downwardly off the blade 26. Suitable pipe shims 100 are positioned between the fingers 28, 28' and prevent the fingers 28' from moving laterally along the rod 96. It will be seen that any reasonable number of intermediate fingers 28' may be placed between the fingers 28 by selecting pipe shims 100 of suitable lengths. The hooks 48' of the fingers 28' prevent the fingers 28' from rotating in the direction shown by the arrow 102.

By using the additional intermediate fingers 28', the spacing between the fingers may be made close enough to pickup man-made litter or debris. The narrower spacing between the fingers does not detract from the ability of the device 10 to pick up seaweed because the fingers are spaced apart sufficiently so that unconsolidated sand passes between the fingers. Thus, a minimum spacing between the edges of the fingers is on the order of about 1".

Figure 12:
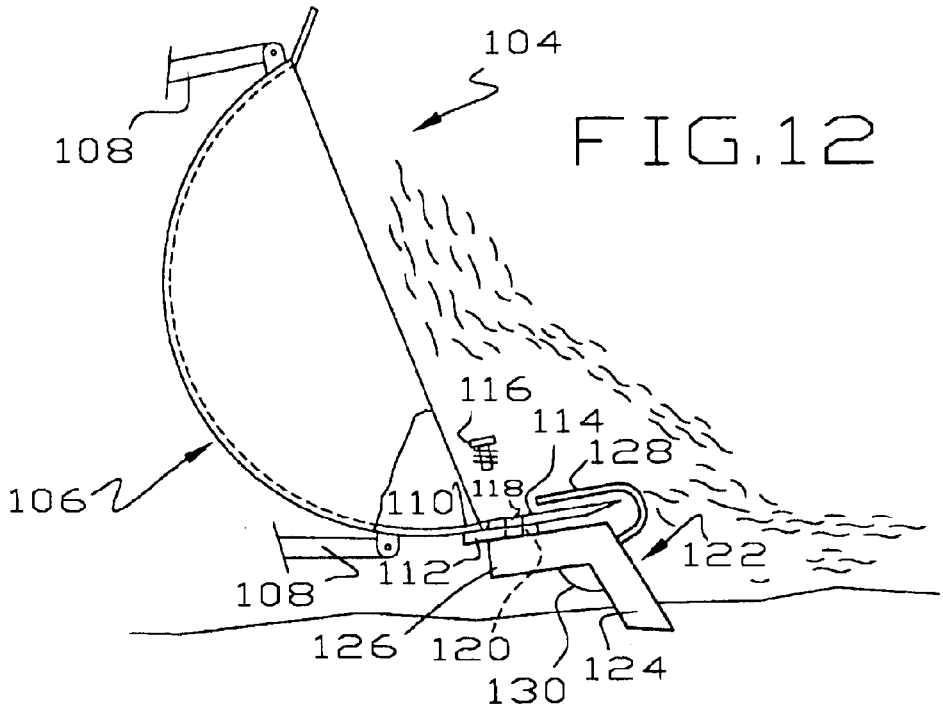
FIG. 12 is a view of part of a front end loader equipped with a seaweed removing attachment of this invention.

Referring to FIG. 12, there is illustrated a motorized wheeled or tracked front end loader 104 having a bucket 106 mounted on suitable pivoted arms 108. The bucket 106 includes a bottom wall 110 having a blade support 112 providing an attachment for a detachable earth engaging blade 114. The blade 114 is secured to the blade support 112 by a series of laterally spaced threaded fasteners 116 passing through aligned openings 118, 120 in the blade 114 and blade support 112. The similarity between the blades and blade supports of the scraper 12 and the front end loader 104 will be apparent.

Figure 11:
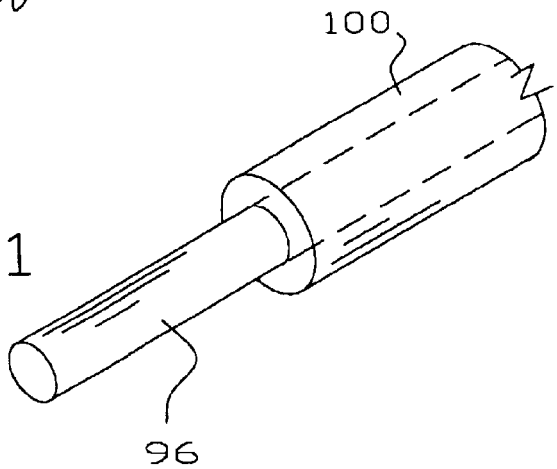
FIG. 11 is an isometric view of a detail in the assembly of FIGS. 9 and 10.

A plurality of laterally spaced fingers 122 are preferably attached to the blade 114 and blade support 112 although the blade 114 could be removed if desired. The fingers 122 provide a ground engaging end 124, a support end 126 receiving the suitable fasteners 116 and a hook or slot forming member 128 for receiving the blade 26 and/or the blade support plate 36. Thus, in its simplest form, the fingers 122 could be identical to the fingers 28. The disadvantage would be that the bucket 106 would have to be tilted to incline the fingers 28 which would reduce the capacity of the bucket 106. To overcome this disadvantage, the ground engaging end 124 of the finger 122 is preferably at an obtuse angle 130 relative to the support end 126. Although any suitable angle may be selected, conveniently, the angle 130 is about 135°. For a seaweed only pick up function, the fingers 122 should be about 6–18" apart. It will be apparent that intermediate fingers, as shown in FIGS. 9–11, may be used between the fingers 122 to provide a litter pick up function. For a seaweed or little pick up function, the fingers 122 should be closer together, but not closer than about 1" between edges.

Figure 13:
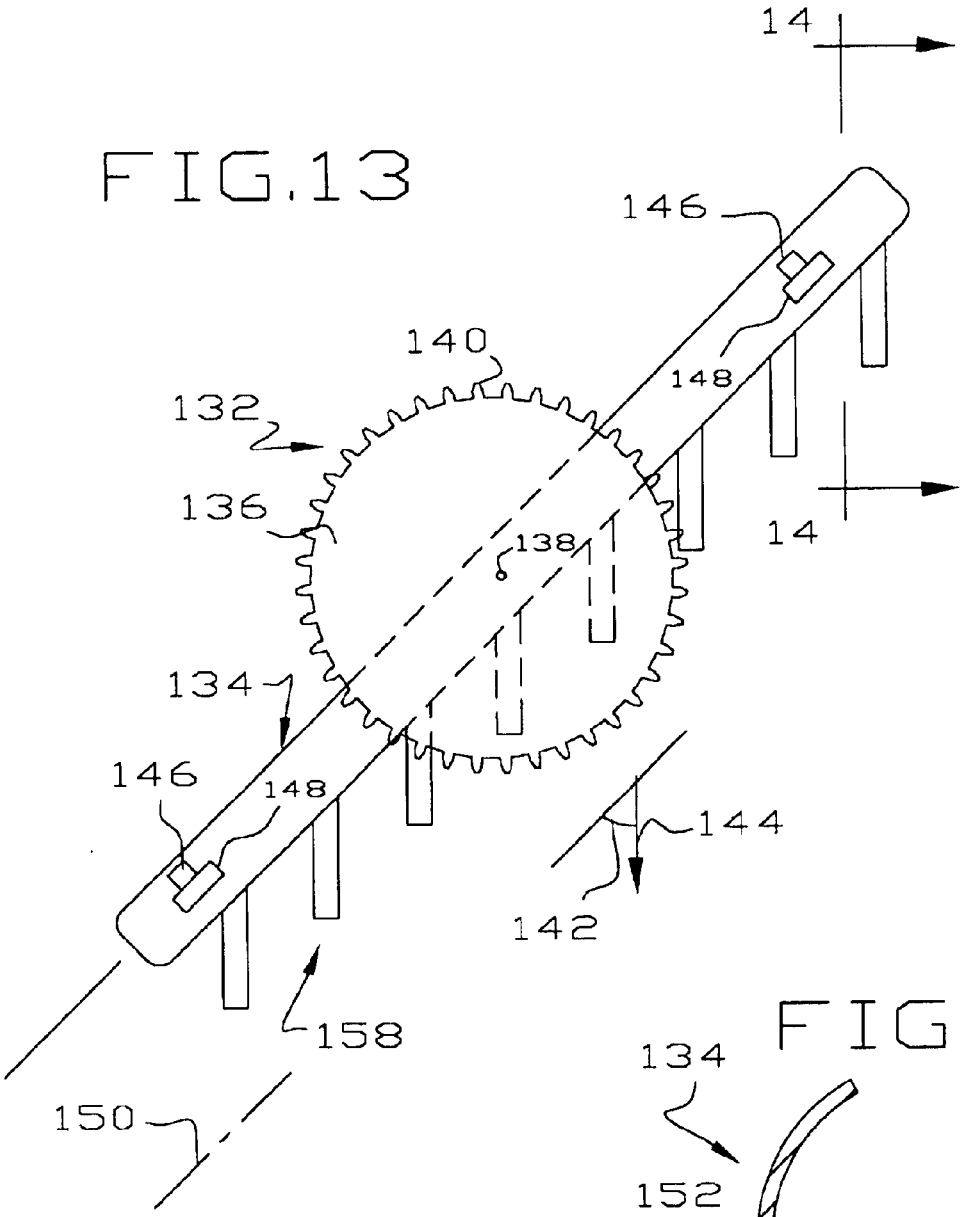
FIG. 13 is a view of part of a motor grader equipped with a seaweed removing attachment of this invention.
Figure 14:
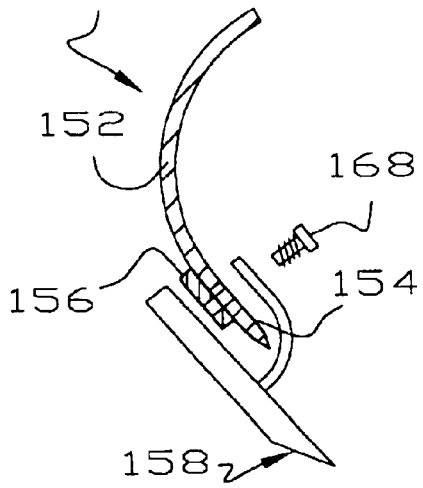
FIG. 14 is an enlarged cross-sectional view of a motor grader blade equipped with a seaweed removing attachment of this invention, taken substantially along line 14—14 of FIG. 13, as viewed in the direction indicated by the arrows.

Referring to FIGS. 13–14, there is illustrated part of a conventional motorized wheeled motor grader 132 that has been modified to pile seaweed and/or litter in a windrow. The motor grader 132 is of a conventional type having a blade assembly 134 mounted on a central hub 136 for rotation about an axis 138. The central hub 136 typically has gear teeth 140 on the circumference that mesh with a suitable motor (not shown) for rotating the hub 136 and thereby positioning the blade assembly 134 at a desired angle 142 to the direction of travel 144 in order to windrow seaweed or other litter. Suitable arms 146 connect to blocks or pivot connections 148 for tilting the blade assembly 134 about a horizontal axis extending in the direction of travel as will be apparent to those skilled in the art. A conventional motor grader 132 also has the capability of tilting the blade assembly 134 about a horizontal axis 150 perpendicular to the direction of travel, the horizonal axis 150 typically being forward of the blade assembly 134.

As shown in FIG. 14, a conventional motor grader blade assembly 134 includes a mold board 152, a replaceable earth working blade 154 with a blade support 156 and fasteners connecting the blade 154 to the mold board 152. To convert the motor grader 132 to a seaweed windrowing device, a series of fingers 158 are attached to the blade support 156, using fasteners 160 preferably without removing the blade 154, in the manner previously described. It will be seen that lowering the fingers 28 into the sand beach 16 and driving along the direction of travel 144 will cause seaweed to stack up in a windrow at the rearward edge of the blade assembly 134. By placing intermediate fingers between the fingers secured to the blade support 156, as in FIGS. 9–11, the motor grader 132 can be modified to windrow man-made litter along with seaweed.

An important feature of this invention is that the fingers 158 extend in the direction of travel 144 rather than perpendicular to the blade assembly 134 or perpendicular to the blade support 156. To this end, a forward or ground engaging end 162 of the finger 158 extends at the angle 142 relative to the blade assembly 134. This means the fingers 158 are positioned parallel to the direction of travel and act like tines or fingers. If the fingers 158 were perpendicular to the blade assembly 134, all of the fingers taken together would act like a blade in front of the blade assembly 134 and create substantial drag on the motor grader 132, interfere with the seaweed or little windrowing operation and provide no beneficial effect.

For a seaweed only windrowing function, the fingers should be about 6–18" apart. It will be apparent that intermediate fingers, as shown in FIGS. 9–11, may be used between the fingers to provide a litter pick up function. For a seaweed or little pick up function, the fingers should be closer together, but not closer than about 1" between edges.

It will be apparent to those skilled in the art that bull dozers have the capability of angularly adjusting the blade relative to the direction of travel. Thus, the fingers 158 may be attached to a bull dozer blade and aligned with the direction of travel in the same manner that they are attached to a motor grader blade.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A beach cleaning machine comprising a general purpose earth moving machine having an earth working implement of a predetermined width and a support, for an earth working blade, extending across the predetermined width of the implement and providing a series of first passages for receiving fasteners attaching the earth working blade to the support, and an attachment for converting the general purpose earth moving machine into a beach litter removing device, including a plurality of fingers having an earth working end projecting away from the blade support, a slot forming member receiving the blade support therein and preventing rotation of the fingers relative to the blade support and a support end having second passages aligned with the first passages, the support ends of the fingers providing phoned openings parallel to the blade support, fasteners extending through the aligned first and second passages attaching the fingers to the blade support, the slot forming members being free of fasteners extending into the blade support, and at least one finger unattached to the blade support and a mechanism securing the unattached finger to adjacent fingers mounted to the blade support, the mechanism including an elongate member behind and below the earth working blade edge slidably and removably received in the aligned opening provided in the support ends.

2. The beach cleaning machine of claim 1 wherein the support end comprises a flat section having the openings therein, the flat section abutting the blade support.

3. The beach cleaning machine of claim 1 wherein the finger comprises an earth working tip and a main body section extending from the support end to the tip and the slot forming member is rigid with the main body section at a first location intermediate the ends of the finger and extends from the first location toward the blade support to a free end, the slot forming member being spaced from the main body section between the first location and the free end thereby providing a slot between the main body section and the slot forming member.

4. The beach cleaning machine of claim 1 wherein the beach cleaning machine includes an earth working blade attached to the blade support, the slot forming member abutting the blade support.

5. The beach cleaning machine of claim 1 wherein the finger is linear from the support end to the earth working end.

6. The beach cleaning machine of claim 1 wherein the earth working end of the finger is inclined relative to the support end.

7. The beach cleaning machine of claim 6 wherein the earth working end of the finger is downwardly inclined relative to the support end.

8. The beach cleaning machine of claim 6 wherein the earth working end of the finger is offset laterally relative to the support end.

9. The beach cleaning machine of claim 1 wherein the slot forming member provides a terminus and the support end extends beyond the terminus of the slot forming member, the fasteners securing the support end to the blade support at a location beyond the terminus of the slot forming member.

10. The beach cleaning machine of claim 1 wherein the general purpose earth moving machine is a scraper having a bowl and a downwardly extending earth engaging blade on the blade support at a location adjacent a front opening of the bowl.

11. The beach cleaning machine of claim 1 wherein the general purpose earth moving machine is a motor grader having a downwardly extending earth engaging blade on the blade support.

12. The beach cleaning machine of claim 1 wherein the general purpose earth moving machine is a front end loader having a bucket providing a blade and the fingers extend downwardly relative to the blade.

13. A beach cleaning machine comprising a general purpose earth moving machine having an earth working implement of a predetermined width and a support, for an earth working blade, extending across the predetermined width of the implement and providing a series of first passages for receiving fasteners attaching the earth working blade to the support, an earth working blade fastened to the support and providing a working edge, and an attachment for converting the general purpose earth moving machine into a beach litter removing device, including a plurality of fingers having an earth working end projecting forwardly away from the blade and blade support and a rearward end located rearwardly and below the working edge of the blade, a slot forming member receiving the earth working blade therein and preventing rotation of the fingers relative to the blade support, a support end having second passages aligned with the first passages, the support ends of the fingers providing aligned openings parallel to the working edge of the blade, fasteners extending through the aligned first and second passages attaching the fingers to the blade support, at least one finger unattached to the blade support and a mechanism securing the unattached finger to adjacent fingers mounted to the blade support, the mechanism including an elongate member behind and below the earth working blade edge slidably and removably received in the phoned openings provided in the support ends.

* * * * *